US010975451B2

(12) United States Patent
Nakajima et al.

(10) Patent No.: US 10,975,451 B2
(45) Date of Patent: Apr. 13, 2021

(54) METHOD FOR PRODUCING NON-ORIENTED ELECTRICAL STEEL SHEET HAVING EXCELLENT MAGNETIC PROPERTIES

(71) Applicant: JFE STEEL CORPORATION, Tokyo (JP)

(72) Inventors: Hiroaki Nakajima, Tokyo (JP); Tomoyuki Okubo, Tokyo (JP); Tadashi Nakanishi, Tokyo (JP); Yoshihiko Oda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 286 days.

(21) Appl. No.: 15/750,037

(22) PCT Filed: Jun. 27, 2016

(86) PCT No.: PCT/JP2016/068943
§ 371 (c)(1),
(2) Date: Feb. 2, 2018

(87) PCT Pub. No.: WO2017/022360
PCT Pub. Date: Feb. 9, 2017

(65) Prior Publication Data

US 2018/0230564 A1 Aug. 16, 2018

(30) Foreign Application Priority Data

Aug. 4, 2015 (JP) ..... JP2015-154110

(51) Int. Cl.
*C21D 8/12* (2006.01)
*C21D 9/46* (2006.01)
(Continued)

(52) U.S. Cl.
CPC ..... *C21D 8/1222* (2013.01); *C21D 8/12* (2013.01); *C21D 8/1216* (2013.01);
(Continued)

(58) Field of Classification Search
CPC ..... C21D 8/1222; C21D 8/12; H01F 1/18; H01F 1/16
See application file for complete search history.

(56) References Cited

U.S. PATENT DOCUMENTS 3,650,851 A 3/1972 Stefan et al.
4,046,602 A * 9/1977 Stanley ..... C21D 8/12 148/111
(Continued)

FOREIGN PATENT DOCUMENTS

CN 1796015 A 7/2006
CN 101218362 A 7/2008
(Continued)

OTHER PUBLICATIONS

KR-20140044929-A English language translation (Year: 2014).*
(Continued)

*Primary Examiner* — Anthony J Zimmer
*Assistant Examiner* — Sean P. O'Keefe
(74) *Attorney, Agent, or Firm* — RatnerPrestia

(57) ABSTRACT

Methods for producing non-oriented electrical steel sheets comprising steps including hot rolling a slab having a chemical composition comprising C: not more than 0.01 mass %, Si: not more than 6 mass %, Mn: 0.05-3 mass %, P: not more than 0.2 mass %, Al: not more than 2 mass %, N: not more than 0.005 mass %, S: not more than 0.01 mass %, Ga: not more than 0.0005 mass %, and the remainder being Fe and inevitable impurities, pickling without conducting hot band annealing or after conducting hot band annealing or self-annealing, subjecting to one or more cold
(Continued)

rollings including an intermediate annealing therebetween and a finish annealing, and forming an insulation coating, an average heating rate from 500 to 800° C. in the heating process of the finish annealing is not less than 50° C./s, whereby a non-oriented electrical steel sheet having excellent magnetic properties is obtained even if hot band annealing is omitted.

12 Claims, 2 Drawing Sheets

(51) Int. Cl.

| | |
|---|---|
| ***C22C 38/06*** | (2006.01) |
| ***C22C 38/60*** | (2006.01) |
| ***H01F 1/16*** | (2006.01) |
| ***C22C 38/00*** | (2006.01) |
| ***C22C 38/02*** | (2006.01) |
| ***H01F 1/18*** | (2006.01) |

(52) U.S. Cl.

CPC ..... *C21D 8/1233* (2013.01); *C21D 8/1244* (2013.01); *C21D 8/1272* (2013.01); *C21D 8/1283* (2013.01); *C21D 9/46* (2013.01); *C22C 38/00* (2013.01); *C22C 38/02* (2013.01); *C22C 38/06* (2013.01); *C22C 38/60* (2013.01); *H01F 1/16* (2013.01); *H01F 1/18* (2013.01); *C21D 8/1266* (2013.01)

(56) References Cited

U.S. PATENT DOCUMENTS

| | | | | |
|---|---|---|---|---|
| 6,773,514 | B1 * | 8/2004 | Kawalla | C21D 8/1222 148/111 |
| 7,470,333 | B2 | 12/2008 | Ohashi et al. | |
| 8,557,058 | B2 | 10/2013 | Arita et al. | |
| 9,978,488 | B2 | 5/2018 | Zaizen et al. | |
| 10,597,759 | B2 | 3/2020 | Nakanishi et al. | |
| 2008/0121314 | A1 | 5/2008 | Choi et al. | |
| 2009/0202383 | A1 | 8/2009 | Tanaka et al. | |
| 2013/0146187 | A1 | 6/2013 | Zaizen et al. | |
| 2013/0263981 | A1 * | 10/2013 | Zaizen | C21D 8/1255 148/645 |
| 2015/0059929 | A1 | 3/2015 | Zaizen et al. | |
| 2015/0357101 | A1 | 12/2015 | Zaizen et al. | |
| 2016/0042850 | A1 | 2/2016 | Oda et al. | |
| 2016/0203896 | A1 | 7/2016 | Nakanishi et al. | |
| 2016/0273064 | A1 | 9/2016 | Kataoka et al. | |
| 2017/0241002 | A1 | 8/2017 | Nakajima et al. | |
| 2018/0066333 | A1 * | 3/2018 | Nakajima | C21D 9/46 |

FOREIGN PATENT DOCUMENTS

| | | | | |
|---|---|---|---|---|
| CN | 103270179 | A | | 8/2013 |
| CN | 105378130 | A | | 3/2016 |
| DE | 1936425 | A1 | | 12/1970 |
| EP | 0334224 | A2 | | 9/1989 |
| EP | 2778246 | A1 | | 9/2014 |
| EP | 2826872 | A1 | | 1/2015 |
| EP | 2975152 | A1 | | 1/2016 |
| EP | 3037565 | A1 | | 6/2016 |
| JP | 60114521 | A | | 6/1985 |
| JP | S62102507 | A | | 5/1987 |
| JP | 05186834 | A | | 7/1993 |
| JP | 0841541 | A | | 2/1996 |
| JP | 09241809 | A | | 9/1997 |
| JP | 09310124 | A | | 12/1997 |
| JP | 2898793 | B2 | | 6/1999 |
| JP | 2000273549 | A | | 10/2000 |
| JP | 2001323345 | A | | 11/2001 |
| JP | 2004292829 | A | | 10/2004 |
| JP | 2005200756 | A | | 7/2005 |
| JP | 2006144036 | A | | 6/2006 |
| JP | 2008524449 | A | | 7/2008 |
| JP | 2011084761 | A | | 4/2011 |
| JP | 4718749 | B2 | | 7/2011 |
| JP | 2011219795 | A | | 11/2011 |
| JP | 2012046806 | A | | 3/2012 |
| JP | 2012132070 | A | | 7/2012 |
| JP | 2013010982 | A | * | 1/2013 |
| JP | 2013010982 | A | | 1/2013 |
| JP | 5228379 | B2 | | 7/2013 |
| JP | 2013133485 | A | | 7/2013 |
| JP | 2013189693 | A | | 9/2013 |
| JP | 2014173099 | A | | 9/2014 |
| JP | 2014198896 | A | | 10/2014 |
| JP | 2015040309 | A | | 3/2015 |
| KR | 100567239 | B1 | | 4/2006 |
| KR | 20140044929 | A | * | 4/2014 ..... C22C 38/22 |
| RU | 2311479 | C2 | | 11/2007 |
| RU | 2398894 | C1 | | 9/2010 |
| RU | 2409693 | C2 | | 1/2011 |
| TW | 201435090 | A | | 9/2014 |
| TW | 201443246 | A | | 11/2014 |
| TW | 201446977 | A | | 12/2014 |
| WO | 2014129034 | A1 | | 8/2014 |
| WO | 2014142100 | A1 | | 9/2014 |
| WO | 2014168136 | A1 | | 10/2014 |
| WO | 2016027565 | A1 | | 2/2016 |

OTHER PUBLICATIONS

Tetsu-to-Hagane, vol. 60 (1974), issue 13, pp. 1869-1878 (Year: 1974).*

Tetsu-to-Hagane, vol. 60 (1974), issue 13, pp. 1869-1878 partial English language translation (Year: 1974).*

Extended European Search Report for European Application No. 16 832 639.5, dated Jun. 1, 2018, 16 pages.

Coombs, A., et al., "Review of the Types, Properties, Advantages, and Latest Developments in Insulating Coatings on Nonoriented Electrical Steels," Jan. 1, 2001, pp. 544-557, vol. 37(1), IEEE Transactions on Magnetics, IEEE Service Center, NY, XP011033313.

International Search Report and Written Opinion for International Application No. PCT/JP2016/068943, dated Sep. 27, 2017—9 Pages.

Japanese Office Action with Concise Statement of Relevance for Japanese Application No. JP2016-561399, dated Sep. 6, 2017—6 Pages.

Taiwanese Office Action with Search Report for Taiwanese Application No. 105121560, dated Feb. 13, 2017—6 Pages.

Korean Office Action for Korean Application No. 10-2017-7037171, dated Jun. 24, 2019, with Concise Statement of Relevance of Office Action, 6 pages.

Chinese Office Action for Chinese Application No. 201680045305.1, dated Nov. 28, 2018 with English Search Report, 11, pages.

Chinese Office Action for Chinese Application No. 201680045305.1, dated Mar. 20, 2019 with English Search Report, 10 pages.

Non Final Office Action for U.S. Appl. No. 15/551,849, dated Apr. 8, 2020, 42 pages.

Lee, S., "Effect of Phosphorus on the Magnetic Properties of Non-oriented Electrical Steel," Doctoral Dissertation, Pohang University of Science and Technology, Dec. 20, 2011, 146 pages.

Korean Office Action for Korean Application No. 2017-7022151, dated Oct. 24, 2018, with Concise Statement of Relevance of Office Action, 6 pages.

Russian Office Action for Russian Application No. 2017130548, dated Jun. 29, 2018, with translation, 8 pages.

Chinese Office Action for Chinese Application No. 201680010167.3, dated Apr. 23, 2018, with translation, 10 pages.

Extended European Search Report for European Application No. 16752142.6, dated Nov. 30, 2017, 11 pages International Search Report and Written Opinion for International Application No. PCT/JP2016/050300, dated Apr. 12, 2016, 5 pages.

(56) References Cited

OTHER PUBLICATIONS

Taiwanese Search Report for Taiwan Application No. 105101735, dated Oct. 6, 2016, with partial translation, 5 pages.

* cited by examiner

METHOD FOR PRODUCING NON-ORIENTED ELECTRICAL STEEL SHEET HAVING EXCELLENT MAGNETIC PROPERTIES

CROSS REFERENCE TO RELATED APPLICATIONS

This is the U.S. National Phase application of PCT/JP2016/068943, filed Jun. 27, 2016, which claims priority to Japanese Patent Application No. 2015-154110, filed Aug. 4, 2015, the disclosures of these applications being incorporated herein by reference in their entireties for all purposes.

FIELD OF THE INVENTION

This invention relates to a method for producing a non-oriented electrical steel sheet, and concretely to a method for producing a non-oriented electrical steel sheet having excellent magnetic properties.

BACKGROUND OF THE INVENTION

A non-oriented electrical steel sheet is a type of soft magnetic material widely used as an iron core material for rotors and the like. In the recent trend of energy saving, there are increasing demands for efficiency improvement, downsizing and weight reduction of electrical machineries. Hence it becomes more important to improve magnetic properties of the iron core material.

The non-electrical steel sheet is usually produced by subjecting a raw steel material (slab) containing silicon to hot rolling, hot-band annealing if necessary, cold rolling and finish annealing. In order to realize excellent magnetic properties, it is required to obtain a texture suitable for the magnetic properties at a stage after the finish annealing. To this end, the hot-band annealing is traditionally considered to be essential.

However, the addition of the hot band annealing process has a problem that not only the number of days for production becomes long but also the production cost is increased. In particular, an increase of the productivity and a decrease of the production cost recently start to be considered important in association with an increase of demands for the electrical steel sheet, and hence techniques of omitting the hot band annealing have been actively developed.

As the technique of omitting the hot-band annealing, for example, Patent Document 1 discloses a method of improving magnetic properties by decreasing S content to not more than 0.0015 mass % to improve growth of crystal grains, adding Sb and Sn to suppress nitriding of the surface layer, and winding the sheet at a high temperature during the hot rolling to coarsen the crystal grain size of the hot rolled sheet having an influence on the magnetic flux density.

Patent Document 2 discloses a technique as to a production method of a non-oriented electrical steel sheet wherein an iron loss is decreased and a magnetic flux density is increased without conducting the hot band annealing by controlling alloy-component elements and optimizing hot rolling conditions using phase transformation of steel to control hot-rolled texture.

PATENT DOCUMENTS

Patent Document 1: JP-A-2000-273549
Patent Document 2: JP-A-2008-524449

SUMMARY OF THE INVENTION

In the method disclosed in Patent Document 1, however, it is necessary to reduce S content to an extremely low amount, so that the production cost (desulfurization cost) is increased. Also, in the method of Patent Document 2, there are many restrictions on steel ingredients and hot rolling conditions, so that there is a problem that the actual production is difficult.

The invention is made in view of the above problems of the conventional art, and an object thereof is to provide a method for producing a non-oriented electrical steel sheet having excellent magnetic properties at a low cost even if the hot band annealing is omitted.

The inventors have focused on an influence of impurities inevitably contained in the raw steel material upon the magnetic properties and made various studies for solving the above task. As a result, it has been found out that the magnetic flux density and the iron loss property can be significantly increased by particularly decreasing Ga among the inevitable impurities to an extremely low amount or further decreasing Al to an extremely low amount even if the hot band annealing is omitted, and benefits of the invention may be obtained.

That is, according to one aspect of the invention, a method for producing a non-oriented electrical steel sheet is provided comprising a series of steps of hot rolling a slab having a chemical composition comprising C: not more than 0.01 mass %, Si: not more than 6 mass %, Mn: 0.05-3 mass %, P: not more than 0.2 mass %, Al: not more than 2 mass %, N: not more than 0.005 mass %, S: not more than 0.01 mass %, Ga: not more than 0.0005 mass %, and the remainder being Fe and inevitable impurities, pickling without conducting a hot band annealing or after conducting a hot band annealing or a self-annealing, subjecting to a single cold rolling or two or more cold rollings including an intermediate annealing therebetween and a finish annealing, and forming an insulation coating, characterized in that an average heating rate from 500 to 800° C. in a heating process during the finish annealing is not less than 50° C./s.

The method for producing a non-oriented electrical steel sheet according to an embodiment of the invention is characterized in that Al content in the chemical composition of the slab is not more than 0.005 mass %.

Also, the slab used in a method for producing the non-oriented electrical steel sheet according to an embodiment of the invention is characterized by containing one or two of Sn: 0.01-0.2 mass % and Sb: 0.01-0.2 mass % in addition to the above chemical composition.

Further, the slab used in a method for producing the non-oriented electrical steel sheet according to an embodiment of the invention is characterized by containing one or more selected from Ca: 0.0005-0.03 mass %, REM: 0.0005-0.03 mass % and Mg: 0.0005-0.03 mass % in addition to the above chemical composition.

Furthermore, a non-oriented electrical steel sheet of an embodiment of the invention is characterized by containing one or more selected from Ni: 0.01-2.0 mass %, Co: 0.01-2.0 mass %, Cu: 0.03-5.0 mass % and Cr: 0.05-5.0 mass % in addition to the above chemical composition.

According to the invention, the non-oriented electrical steel sheet having excellent magnetic properties can be produced even if the hot band annealing is omitted, so that it is possible to provide non-oriented electrical steel sheets having excellent magnetic properties at a low cost in a short period of time.

DETAILED DESCRIPTION OF EMBODIMENTS OF THE INVENTION

First, experiments building a momentum on the development of the invention will be described.

<Experiment 1>

The inventors have investigated the influence of Ga content as an inevitable impurity upon the magnetic flux density to develop a non-oriented electrical steel sheet having excellent magnetic properties even if the hot-band annealing is omitted.

Steels prepared by variously changing an addition amount of Ga within a range of tr.-0.002 mass % in a chemical composition system comprising C: 0.0025 mass %, Si: 3.0 mass %, Mn: 0.25 mass %, P: 0.01 mass %, N: 0.002 mass %, S: 0.002 mass % and Al: two levels of 0.2 mass % and 0.002 mass % are melted and casted in a laboratorial way to form steel ingots, which are hot rolled to form hot rolled sheets of 3.0 mm in thickness and subjected to a heat treatment corresponding to a coiling temperature of 750° C. Thereafter, the hot rolled sheets are pickled without conducting a hot band annealing and cold rolled to form cold rolled sheets having a thickness of 0.50 mm, which are subjected to a finish annealing at 1000° C. for 10 seconds under an atmosphere of 20 vol % $H_2$-80 vol % $N_2$. Moreover, an average heating rate from 500 to 800° C. in the finish annealing is set to 70° C./s.

Figure 1:
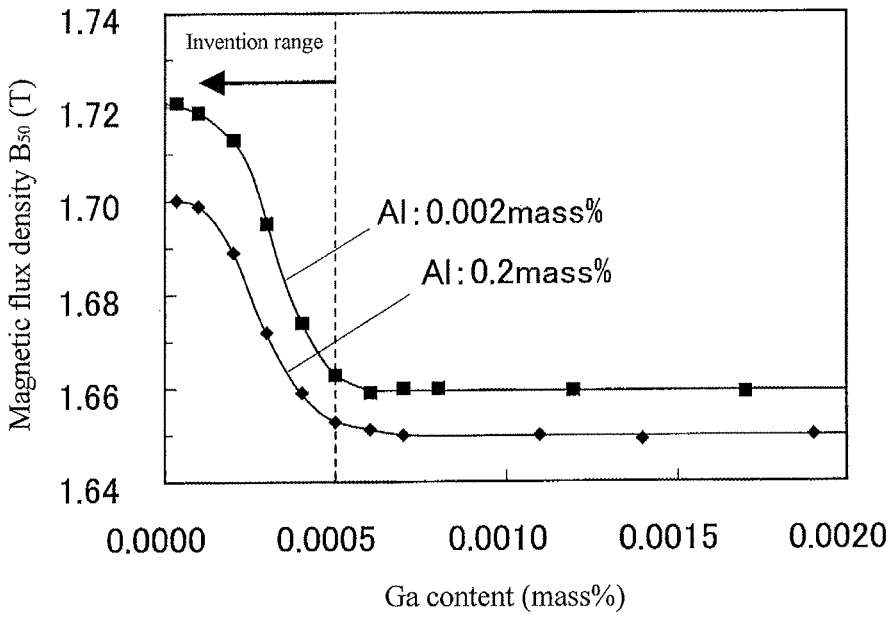
FIG. 1 is a graph showing an influence of Ga content upon a magnetic flux density $B_{50}$.

Magnetic flux densities $B_{50}$ of the thus obtained steel sheets after the finish annealing are measured by a 25 cm Epstein method to obtain results shown in FIG. 1.

It can be seen from the results that the magnetic flux density $B_{50}$ is rapidly increased when the Ga content is not more than 0.0005 mass %, and the effect of increasing the magnetic flux density due to the decrease of Ga content is larger when Al content is 0.002 mass % than 0.2 mass %.

<Experiment 2>

The inventors have conducted an experiment to investigate the influence of Al content upon the magnetic flux density.

Steels prepared by variously changing an addition amount of Al within a range of tr.-0.01 mass % in a chemical composition system comprising C: 0.0025 mass %, Si: 3.0 mass %, Mn: 0.25 mass %, P: 0.01 mass %, N: 0.002 mass %, S: 0.002 mass % and Ga decreased to 0.0002 mass % are melted in a laboratorial way and magnetic flux densities $B_{50}$ of the steel sheets after the finish annealing are measured by a 25 cm Epstein method in the same way as in Experiment 1.

Figure 2:
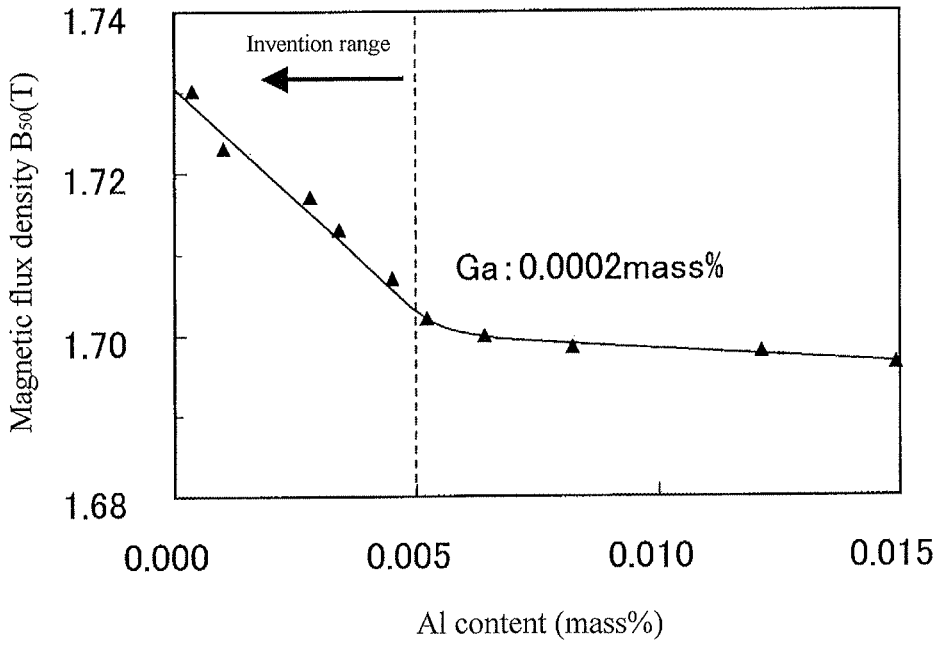
FIG. 2 is a graph showing an influence of Al content upon a magnetic flux density $B_{50}$.

FIG. 2 shows the relationship between Al content and magnetic flux density $B_{50}$ with respect to the above measured results. As seen from FIG. 2, the magnetic flux density is increased when Al content is not more than 0.005 mass %.

As seen from the above experimental results, the magnetic flux density can be significantly increased by decreasing Ga content to not more than 0.0005 mass % and further by decreasing Ga content to not more than 0.0005 mass % while decreasing Al content to not more than 0.005 mass %.

The reason why the magnetic flux density is significantly increased by the decreases of Ga content and/or Al content is not entirely clear, but we believe that the recrystallization temperature of the raw material is lowered by decreasing Ga to change recrystallization behavior in the hot rolling to thereby improve the texture of the hot rolled sheet. Particularly, the reason why the magnetic flux density is considerably increased when Al content is not more than 0.005 mass % is believed due to the fact that mobility of grain boundary is changed by the decrease of Ga and Al to promote growth of crystal orientation advantageous for the magnetic properties.

The invention is developed based on the above new knowledge.

<Experiment 3>

Next, the inventors have conducted an experiment to investigate the influence of the heating rate in the finish annealing upon the magnetic flux density.

Steels containing C: 0.0025 mass %, Si: 3.0 mass %, Mn: 0.25 mass %, P: 0.01 mass %, N: 0.002 mass %, S: 0.002 mass %, Al: 0.002 mass %, and Ga: two levels of 0.0001 mass % and 0.001 mass % are melted in a laboratorial way and magnetic flux densities $B_{50}$ of the steel sheets after the finish annealing are measured by a 25 cm Epstein apparatus in the same way as in Experiment 1. In this regard, an average heating rate from 500 to 800° C. in the finish annealing is varied within a range of 20-300° C./s.

Figure 3:
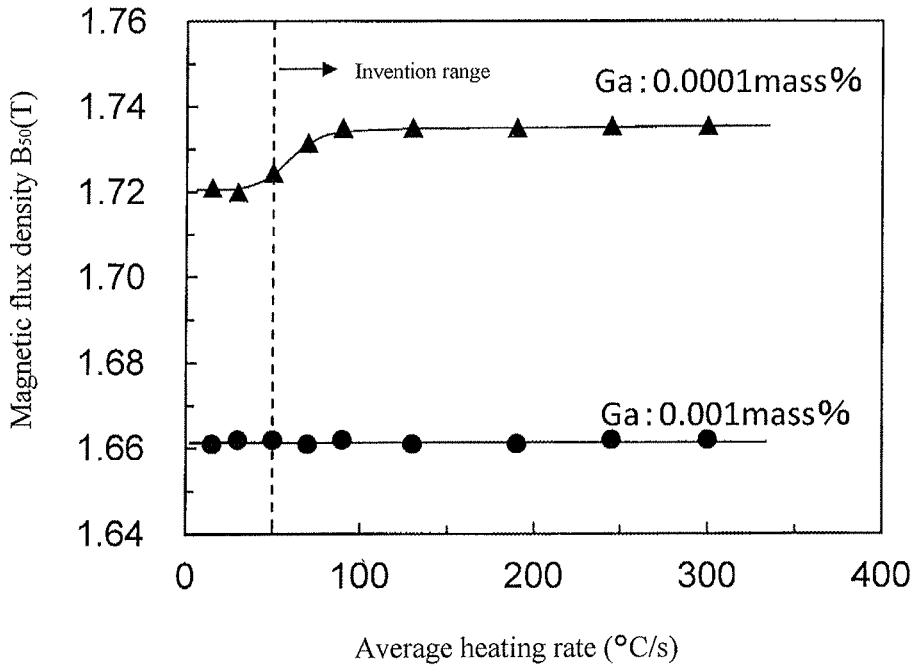
FIG. 3 is a graph showing an influence of an average heating rate in a finish annealing upon a magnetic flux density $B_{50}$.

FIG. 3 shows a relationship between the average heating rate in the finish annealing and magnetic flux density $B_{50}$ with respect to the above measured results.

As seen from FIG. 3, the magnetic flux density $B_{50}$ is substantially constant irrespective of the heating rate in the steel sheet having Ga content of 0.001 mass %, while the magnetic flux density $B_{50}$ is increased in the steel sheet with Ga content decreased to 0.0001 mass % when the heating rate is not less than 50° C./s. It can be seen from the above experimental results that the magnetic flux density can be further increased by decreasing Ga content to not more than 0.0005 mass % and Al content to not more than 0.005 mass % while increasing the average heating rate in the finish annealing to not less than 50° C./s. The reason why the magnetic flux density is significantly increased by decreasing Ga content and increasing the heating rate is not entirely clear at this moment, but it is considered due to the fact that recrystallization of {110} grains and {100} grains promoted by the rapid heating is further expedited by the decrease of Ga to increase grains having an orientation of an easy magnetization axis.

The invention is developed based on the above new knowledge.

Next, there will be explained a chemical composition required in the slab used in the production of the non-oriented electrical steel sheet according to an aspect of the invention.

C: not more than 0.01 mass %

C causes magnetic aging in a product sheet, so that it is limited to not more than 0.01 mass %. Preferably, it is not more than 0.005 mass %, and more preferably not more than 0.003 mass %.

Si: not more than 6 mass %

Si is an element effective to increase a specific resistance of steel to decrease an iron loss, so that it is preferable to be contained in an amount of not less than 1 mass %. When it is added in an amount exceeding 6 mass %, however, it is difficult to perform cold rolling because considerable embrittlement is caused, so that the upper limit is set to 6 mass %. Preferably, it falls in a range of 1-4 mass %, and more preferably a range of 1.5-3 mass %.

Mn: 0.05-3 mass %

Mn is an element effective for preventing red brittleness in the hot rolling, and therefore it is required to be contained in an amount of not less than 0.05 mass %. When it exceeds 3 mass %, however, cold rolling property is deteriorated or decrease of the magnetic flux density is caused, so that the upper limit is set to 3 mass %. Preferably, it is a range of 0.05-1.5 mass % More preferably, it is a range of 0.2-1.3 mass %.

P: not more than 0.2 mass %

P can be added because it is excellent in the solid-solution strengthening ability and is an element effective of adjusting hardness to improve punchability of steel. However, when the amount exceeds 0.2 mass %, embrittlement becomes remarkable, so that the upper limit is set to 0.2 mass %. Preferably, it is not more than 0.15 mass %, more preferably not more than 0.1 mass %.

S: not more than 0.01 mass %

S is a harmful element forming sulfide such as MnS or the like to increase the iron loss, so that the upper limit is set to 0.01 mass %. Preferably, it is not more than 0.005 mass %, and more preferably not more than 0.003 mass %.

Al: not more than 2 mass %

Al can be added because it is an element effective in increasing a specific resistance of steel and decreasing an eddy current loss. However, when it exceeds 2.0 mass %, the cold rolling property is deteriorated, so that the upper limit is set to 2.0 mass %.

In order to more receive the effect of improving the magnetic properties by the decrease of Ga, it is effective to be decreased to not more than 0.005 mass %. More preferably, it is not more than 0.001 mass %.

N: not more than 0.005 mass %

N is a harmful element forming nitride to increase the iron loss, so that the upper limit is set to 0.005 mass %. Preferably, it is not more than 0.003 mass %.

Ga: not more than 0.0005 mass %

Ga is an important element because it has a substantial bad influence on a texture of a hot rolled sheet even in a slight amount. To suppress the bad influence, it is not more than 0.0005 mass %. Preferably, it is not more than 0.0003 mass %, more preferably not more than 0.0001 mass %.

The slab used in the production of the non-oriented electrical steel sheet may contain one or two of Sn and Sb in ranges of Sb: 0.01-0.2 mass % and Sn: 0.01-0.2 mass % in addition to the above ingredients for improving the magnetic properties.

Sb and Sn improve a texture of a product sheet and are elements effective for increasing the magnetic flux density. The above effect is obtained in an addition amount of not less than 0.01 mass %. On the other hand, when it exceeds 0.2 mass %, the above effect is saturated. Therefore, when adding the elements, each element is preferable to be a range of 0.01-0.2 mass %. More preferably, it is a range of Sb: 0.02-0.15 mass % and Sn: 0.02-0.15 mass %.

The slab used in the production of the non-oriented electrical steel sheet may further contain one or more selected from Ca, REM and Mg in ranges of Ca: 0.0005-0.03 mass %, REM: 0.0005-0.03 mass % and Mg: 0.0005-0.03 mass % in addition to the above ingredients.

Each of Ca, REM and Mg fixes S to suppress fine precipitation of sulfide and is an element effective for decreasing the iron loss. In order to obtain such an effect, each element may be added in an amount of not less than 0.0005 mass %. However, when it is added in an amount exceeding 0.03 mass %, the effect is saturated. Therefore, in the case of adding Ca, REM and Mg, each element is preferable to be a range of 0.0005-0.03 mass %. More preferably, it is a range of 0.001-0.01 mass %.

The non-oriented electrical steel sheet may further contain one or more selected from Ni, Co, Cu and Cr in ranges of Ni: 0.01-2.0 mass %, Co: 0.01-2.0 mass %, Cu: 0.03-5.0 mass % and Cr: 0.05-5.0 mass % in addition to the above ingredients. Ni, Co, Cu and Cr are elements effective for decreasing the iron loss because each element increases the specific resistance of steel. In order to obtain such an effect, it is preferable to add Ni and Co in an amount of not less than 0.01 mass % for each, Cu in an amount of not less than 0.03 mass % and Cr in an amount of not less than 0.05 mass %. However, when Ni and Co are added in an amount exceeding 2.0 mass % and Cu and Cr are added in an amount exceeding 5.0 mass %, an alloy cost is increased. Therefore, when adding Ni and Co, the addition amount of each preferably falls in a range of 0.01-2.0 mass %, and when adding Cu, the addition amount preferably falls in a range of 0.03-5.0 mass %, and when adding Cr, the addition amount falls in a range of 0.05-5.0 mass %. More preferably, it is Ni: 0.03-1.5 mass %, Co: 0.03-1.5 mass %, Cu: 0.05-3.0 mass % and Cr: 0.1-3.0 mass %.

The remainder other than the above ingredients in the slab used in the production for a non-oriented electrical steel sheet is Fe and inevitable impurities. However, the addition of other elements may be accepted within a range not damaging the desired effects of the invention.

Next, the method of producing the non-oriented electrical steel sheet according to an aspect of the invention will be described below.

The non-oriented electrical steel sheet according to the invention can be produced by the conventionally well-known production method for the non-oriented electrical steel sheet as long as Ga and Al are contained in the aforementioned ranges as a raw material used in the production. For example, it can be produced by a method wherein a steel adjusted to have the predetermined chemical composition in a refining process of melting the steel in a converter, an electric furnace or the like and performing secondary refining in a vacuum degassing apparatus or the like is subjected to an ingot making-blooming method or continuous casting to form a raw steel material (slab), which is then subjected to hot rolling, pickling, cold rolling, finish annealing, and an application and baking of an insulation coating.

In the production method of the non-oriented electrical steel sheet according to the invention, excellent magnetic properties can be obtained even if hot band annealing after hot rolling is omitted. However, hot band annealing may be conducted, and at this time, a soaking temperature is preferable to be a range of 900-1200° C. When the soaking temperature is lower than 900° C., the effect by the hot band annealing cannot be obtained sufficiently and hence the effect of further improving the magnetic properties cannot be obtained. On the other hand, when it exceeds 1200° C., the grain size of the hot rolled sheet is coarsened too much, and there is a fear of causing cracks or fractures during the cold rolling and it becomes disadvantageous to the cost.

When the hot band annealing is omitted, a self-annealing may be performed by increasing a coiling temperature after the hot rolling. The coiling temperature is preferably not lower than 650° C. from a viewpoint of sufficiently recrystallizing the steel sheet before the cold rolling or the hot rolled sheet. More preferably, it is not lower than 670° C.

Also, the cold rolling from the hot rolled sheet to the cold rolled sheet with a product sheet thickness (final thickness) may be conducted once or twice or more interposing an intermediate annealing therebetween. In particular, the final cold rolling to the final thickness preferably adopts a warm rolling performed at a sheet temperature of approximately 200° C. because it has a large effect of increasing the magnetic flux density as long as there is no problem in equipment, production constraint or cost.

The finish annealing applied to the cold rolled sheet with a final thickness is preferably a continuous annealing performed by soaking at a temperature of 900-1150° C. for 5-60 seconds. When the soaking temperature is lower than 900° C., the recrystallization is not promoted sufficiently and good magnetic properties are not obtained. While when it exceeds 1150° C., crystal grains are coarsened and the iron loss at a high frequency zone is particularly increased. More preferably, the soaking temperature falls in a range of 950–1100° C.

It is important to conduct a rapid heating at an average heating rate of not less than 50° C./s from 500° C. to 800° C. in the heating process during the finish annealing. The reason is that recrystallization of {110} and {100} grains promoted by the rapid heating is further expedited by the decrease of Ga to obtain an effect of increasing grains oriented in the easy magnetization axis. It is preferably not less than 100° C./s, more preferably not less than 150° C./s.

Moreover, the method of performing the rapid heating is not particularly limited. For example, a direct electric heating method, an induction heating method and so on can be used.

The steel sheet after the finish annealing is preferably coated on its surface with an insulation coating for increasing interlayer resistance to decrease the iron loss. It is particularly desirable to apply a semi-organic insulation coating containing a resin for ensuring a good punchability.

The non-oriented electrical steel sheet coated with the insulation coating may be used after subjected to a stress relief annealing by users, or may be used without the stress relief annealing. Also, a stress relief annealing may be performed after a punching process is conducted by users. The stress relief annealing is usually performed under a condition at about 750° C. for 2 hours.

Example 1

Steels No. 1-33 having a chemical composition shown in Table 1 are melted in a refining process of convertor-vacuum degassing treatment and continuously casted to form steel slabs, which are heated at a temperature of 1140° C. for 1 hour and hot rolled at a finish hot rolling temperature of 900° C. to form hot rolled sheets having a sheet thickness of 3.0 mm, and wound around a coil at a temperature of 750° C. Next, the coil is pickled without being subjected to a hot band annealing, and cold rolled once to provide a cold rolled sheet having a sheet thickness of 0.5 mm, which is subjected to a finish annealing under a soaking conditions at 1000° C. for 10 seconds to provide a non-oriented electrical steel sheet. The heating rate in the finish annealing is set to 70° C./s.

From the thus obtained steel sheet are taken out Epstein test specimens of 30 mm×280 mm to measure an iron loss $W_{15/50}$ and a magnetic flux density $B_{50}$ by a 25 cm Epstein apparatus, the results of which are also shown in Table 1.

As seen from Table 1, non-oriented electrical steel sheets having excellent magnetic properties can be obtained by controlling a chemical composition of a raw steel material (slab) and the heating rate in the finish annealing to the ranges herein even if the hot band annealing is omitted.

TABLE 1

| | Chemical composition (mass %) | | | | | | | | | | | | Magnetic properties | | |
|---|---|---|---|---|---|---|---|---|---|---|---|---|---|---|---|
| | | | | | | | | | | | | | Iron loss $W_{15/50}$ | Magnetic flux density | |
| No | C | P | Si | Mn | Al | N | S | Ga | Sn | Sb | Ca | REM | (W/kg) | $B_{50}$ (T) | Remarks |
| 1 | 0.0029 | 0.01 | 3.02 | 0.255 | 0.19 | 0.0019 | 0.0019 | 0.0001 | — | — | — | — | 2.75 | 1.701 | Inventive Example |
| 2 | 0.0024 | 0.02 | 2.97 | 0.210 | 0.20 | 0.0020 | 0.0018 | 0.0003 | — | — | — | — | 2.96 | 1.673 | Inventive Example |
| 3 | 0.0028 | 0.01 | 3.00 | 0.248 | 0.006 | 0.0022 | 0.0022 | 0.0001 | — | — | — | — | 2.79 | 1.706 | Inventive Example |
| 4 | 0.0025 | 0.02 | 2.99 | 0.251 | 0.003 | 0.0020 | 0.0023 | 0.0001 | — | — | — | — | 2.72 | 1.718 | Inventive Example |
| 5 | 0.0026 | 0.01 | 2.97 | 0.251 | 0.001 | 0.0021 | 0.0021 | 0.0001 | — | — | — | — | 2.64 | 1.731 | Inventive Example |
| 6 | 0.0023 | 0.02 | 3.04 | 0.252 | 0.18 | 0.0022 | 0.0019 | 0.0007 | — | — | — | — | 3.23 | 1.651 | Comparative Example |
| 7 | 0.0024 | 0.01 | 3.03 | 0.251 | 0.001 | 0.0017 | 0.0023 | 0.0006 | — | — | — | — | 3.26 | 1.661 | Comparative Example |
| 8 | 0.0023 | 0.01 | 1.52 | 0.256 | 0.24 | 0.0021 | 0.0024 | 0.0001 | — | — | — | — | 3.01 | 1.738 | Inventive Example |
| 9 | 0.0025 | 0.02 | 1.49 | 0.252 | 0.007 | 0.0019 | 0.0024 | 0.0001 | — | — | — | — | 3.06 | 1.745 | Inventive Example |
| 10 | 0.0025 | 0.01 | 1.45 | 0.254 | 0.001 | 0.0018 | 0.0022 | 0.0001 | — | — | — | — | 2.92 | 1.768 | Inventive Example |
| 11 | 0.0025 | 0.01 | 1.54 | 0.247 | 0.22 | 0.0018 | 0.0016 | 0.0006 | — | — | — | — | 3.53 | 1.687 | Comparative Example |
| 12 | 0.0220 | 0.02 | 2.99 | 0.249 | 0.26 | 0.0020 | 0.0019 | 0.0001 | — | — | — | — | 4.04 | 1.651 | Comparative Example |
| 13 | 0.0028 | 0.22 | 2.98 | 0.252 | 0.19 | 0.0023 | 0.0019 | 0.0001 | — | — | — | — | Cannot be rolled due to embrittlement | | Comparative Example |
| 14 | 0.0031 | 0.02 | 3.03 | 3.210 | 0.21 | 0.0021 | 0.0021 | 0.0001 | — | — | — | — | Cannot be rolled due to embrittlement | | Comparative Example |
| 15 | 0.0027 | 0.02 | 3.02 | 0.251 | 2.21 | 0.0023 | 0.0020 | 0.0001 | — | — | — | — | Cannot be rolled due to embrittlement | | Comparative Example |
| 16 | 0.0028 | 0.03 | 2.94 | 0.255 | 0.21 | 0.0054 | 0.0027 | 0.0001 | — | — | — | — | 3.79 | 1.659 | Comparative Example |

TABLE 1-continued

| No | Chemical composition (mass %) C | P | Si | Mn | Al | N | S | Ga | Sn | Sb | Ca | REM | Magnetic properties Iron loss $W_{15/50}$ (W/kg) | Magnetic flux density $B_{50}$ (T) | Remarks |
|---|---|---|---|---|---|---|---|---|---|---|---|---|---|---|---|
| 17 | 0.0022 | 0.03 | 3.05 | 0.252 | 0.19 | 0.0016 | 0.0130 | 0.0001 | — | — | — | — | 3.72 | 1.661 | Comparative Example |
| 18 | 0.0031 | 0.02 | 3.02 | 0.247 | 0.001 | 0.0020 | 0.0021 | 0.0001 | 0.04 | — | — | — | 2.58 | 1.745 | Inventive Example |
| 19 | 0.0035 | 0.01 | 2.97 | 0.256 | 0.001 | 0.0021 | 0.0026 | 0.0001 | — | 0.03 | — | — | 2.59 | 1.743 | Inventive Example |
| 20 | 0.0032 | 0.02 | 3.06 | 0.249 | 0.001 | 0.0022 | 0.0030 | 0.0001 | 0.03 | 0.03 | — | — | 2.53 | 1.756 | Inventive Example |
| 21 | 0.0027 | 0.01 | 3.02 | 0.255 | 0.001 | 0.0024 | 0.0030 | 0.0001 | 0.04 | — | 0.003 | — | 2.52 | 1.753 | Inventive Example |
| 22 | 0.0024 | 0.02 | 3.04 | 0.250 | 0.001 | 0.0021 | 0.0025 | 0.0001 | 0.04 | — | — | 0.004 | 2.52 | 1.755 | Inventive Example |
| 23 | 0.0061 | 0.01 | 3.02 | 0.251 | 0.001 | 0.0017 | 0.0019 | 0.0001 | — | — | — | — | 2.91 | 1.720 | Inventive Example |
| 24 | 0.0093 | 0.01 | 2.98 | 0.252 | 0.001 | 0.0020 | 0.0020 | 0.0001 | — | — | — | — | 3.13 | 1.702 | Inventive Example |
| 25 | 0.0029 | 0.02 | 0.55 | 0.252 | 0.001 | 0.0022 | 0.0022 | 0.0001 | — | — | — | — | 3.32 | 1.745 | Inventive Example |
| 26 | 0.0031 | 0.01 | 5.02 | 0.248 | 0.001 | 0.0023 | 0.0018 | 0.0001 | — | — | — | — | 2.41 | 1.720 | Inventive Example |
| 27 | 0.0024 | 0.02 | 2.99 | 0.064 | 0.001 | 0.0019 | 0.0019 | 0.0001 | — | — | — | — | 2.72 | 1.736 | Inventive Example |
| 28 | 0.0027 | 0.02 | 2.97 | 1.989 | 0.001 | 0.0019 | 0.0021 | 0.0001 | — | — | — | — | 2.44 | 1.722 | Inventive Example |
| 29 | 0.0027 | 0.09 | 3.00 | 0.256 | 0.001 | 0.0021 | 0.0022 | 0.0001 | — | — | — | — | 2.65 | 1.737 | Inventive Example |
| 30 | 0.0029 | 0.19 | 3.01 | 0.247 | 0.001 | 0.0023 | 0.0023 | 0.0001 | — | — | — | — | 2.64 | 1.738 | Inventive Example |
| 31 | 0.0033 | 0.01 | 3.01 | 0.251 | 1.95 | 0.0021 | 0.0018 | 0.0001 | — | — | — | — | 2.42 | 1.688 | Inventive Example |
| 32 | 0.0031 | 0.02 | 3.03 | 0.248 | 0.001 | 0.0048 | 0.0017 | 0.0001 | — | — | — | — | 3.32 | 1.678 | Inventive Example |
| 33 | 0.0032 | 0.02 | 2.98 | 0.255 | 0.001 | 0.0022 | 0.0094 | 0.0001 | — | — | — | — | 3.22 | 1.682 | Inventive Example |

Example 2

Steels No. 1-33 having a chemical composition shown in Table 1 are melted in a refining process of convertor-vacuum degassing treatment and continuously casted to form steel slabs, which are heated at 1140° C. for 1 hour and hot rolled at a finish hot rolling temperature of 900° C. to form hot rolled sheets having a sheet thickness of 3.0 mm, and wound around a coil at a temperature of 750° C. Next, the coil is pickled without being subjected to a hot band annealing, and cold rolled once to provide a cold rolled sheet having a sheet thickness of 0.5 mm, which is subjected to a finish annealing under soaking conditions of 1000° C. and 10 seconds to provide a non-oriented electrical steel sheet. The average heating rate from 500° C. to 800° C. in the finish annealing is varied within a range of 20-300° C./s.

From the thus obtained steel sheet are taken out Epstein test specimens of 30 mm×280 mm to measure an iron loss $W_{15/50}$ and a magnetic flux density $B_{50}$ by a 25 cm Epstein apparatus, the results of which are also shown in Table 2.

As seen from Table 2, non-oriented electrical steel sheets having excellent magnetic properties can be obtained by controlling a chemical composition of a raw steel material (slab) to the range defined herein or by controlling a chemical composition of a raw steel material (slab) and a heating rate in the finish annealing to the ranges defined herein even if the hot band annealing is omitted.

TABLE 2

| No | Chemical composition (mass %) C | P | Si | Mn | Al | N | S | Ga | Sn | Sb | Ca | REM | Hating rate in finish annealing (° C./s) | Magnetic properties Iron loss $W_{15/50}$ (W/kg) | Magnetic flux density $B_{50}$ (T) | Remarks |
|---|---|---|---|---|---|---|---|---|---|---|---|---|---|---|---|---|
| 1 | 0.0028 | 0.01 | 2.97 | 0.251 | 0.001 | 0.0019 | 0.0022 | 0.0001 | — | — | — | — | 20 | 2.78 | 1.708 | Comparative Example |
| 2 | 0.0029 | 0.02 | 3.00 | 0.248 | 0.001 | 0.0020 | 0.0020 | 0.0001 | — | — | — | — | 40 | 2.67 | 1.718 | Comparative Example |
| 3 | 0.0031 | 0.01 | 3.01 | 0.254 | 0.001 | 0.0020 | 0.0020 | 0.0001 | — | — | — | — | 50 | 2.62 | 1.725 | Inventive Example |
| 4 | 0.0030 | 0.01 | 3.02 | 0.250 | 0.001 | 0.0022 | 0.0022 | 0.0001 | — | — | — | — | 75 | 2.60 | 1.729 | Inventive Example |
| 5 | 0.0025 | 0.02 | 2.96 | 0.255 | 0.001 | 0.0020 | 0.0019 | 0.0001 | — | — | — | — | 100 | 2.59 | 1.734 | Inventive Example |
| 6 | 0.0029 | 0.02 | 3.01 | 0.252 | 0.001 | 0.0022 | 0.0023 | 0.0001 | — | — | — | — | 125 | 2.59 | 1.734 | Inventive Example |
| 7 | 0.0031 | 0.01 | 2.98 | 0.247 | 0.001 | 0.0019 | 0.0021 | 0.0001 | — | — | — | — | 150 | 2.58 | 1.734 | Inventive Example |
| 8 | 0.0029 | 0.02 | 2.99 | 0.244 | 0.001 | 0.0021 | 0.0023 | 0.0001 | — | — | — | — | 200 | 2.58 | 1.735 | Inventive Example |
| 9 | 0.0028 | 0.02 | 2.98 | 0.248 | 0.001 | 0.0023 | 0.0022 | 0.0001 | — | — | — | — | 300 | 2.59 | 1.735 | Inventive Example |
| 10 | 0.0027 | 0.01 | 3.00 | 0.255 | 0.001 | 0.0018 | 0.0018 | 0.0004 | — | — | — | — | 100 | 2.77 | 1.709 | Inventive Example |
| 11 | 0.0028 | 0.01 | 2.97 | 0.252 | 0.001 | 0.0019 | 0.0022 | 0.0007 | — | — | — | — | 100 | 3.21 | 1.662 | Comparative Example |
| 12 | 0.0032 | 0.02 | 3.03 | 0.248 | 0.20 | 0.0018 | 0.0018 | 0.0001 | — | — | — | — | 40 | 2.78 | 1.702 | Comparative Example |
| 13 | 0.0024 | 0.02 | 2.99 | 0.247 | 0.19 | 0.0018 | 0.0021 | 0.0001 | — | — | — | — | 50 | 2.73 | 1.709 | Inventive Example |
| 14 | 0.0029 | 0.01 | 3.02 | 0.251 | 0.19 | 0.0022 | 0.0019 | 0.0001 | — | — | — | — | 75 | 2.71 | 1.712 | Inventive Example |
| 15 | 0.0027 | 0.01 | 3.00 | 0.255 | 0.20 | 0.0018 | 0.0018 | 0.0001 | — | — | — | — | 100 | 2.70 | 1.714 | Inventive Example |
| 16 | 0.0028 | 0.02 | 3.02 | 0.252 | 0.21 | 0.0021 | 0.0021 | 0.0001 | — | — | — | — | 125 | 2.70 | 1.714 | Inventive Example |
| 17 | 0.0032 | 0.02 | 3.03 | 0.252 | 0.21 | 0.0020 | 0.0020 | 0.0001 | — | — | — | — | 150 | 2.69 | 1.712 | Inventive Example |

TABLE 2-continued

| No | Chemical composition (mass %) | | | | | | | | | | | | Hating rate in finish annealing (° C./s) | Magnetic properties Iron loss $W_{15/50}$ (W/kg) | Magnetic flux density $B_{50}$ (T) | Remarks |
|---|---|---|---|---|---|---|---|---|---|---|---|---|---|---|---|---|
| | C | P | Si | Mn | Al | N | S | Ga | Sn | Sb | Ca | REM | | | | |
| 18 | 0.0028 | 0.01 | 2.97 | 0.252 | 0.20 | 0.0019 | 0.0022 | 0.0001 | — | — | — | — | 200 | 2.69 | 1.715 | Inventive Example |
| 19 | 0.0026 | 0.01 | 1.47 | 0.252 | 0.001 | 0.0019 | 0.0021 | 0.0001 | — | — | — | — | 20 | 3.10 | 1.745 | Comparative Example |
| 20 | 0.0031 | 0.01 | 1.52 | 0.248 | 0.001 | 0.0019 | 0.0020 | 0.0001 | — | — | — | — | 50 | 2.97 | 1.762 | Inventive Example |
| 21 | 0.0030 | 0.02 | 1.51 | 0.249 | 0.001 | 0.0021 | 0.0017 | 0.0001 | — | — | — | — | 100 | 2.81 | 1.773 | Inventive Example |
| 22 | 0.0029 | 0.02 | 1.47 | 0.248 | 0.001 | 0.0022 | 0.0019 | 0.0001 | — | — | — | — | 200 | 2.80 | 1.774 | Inventive Example |
| 23 | 0.0059 | 0.01 | 3.01 | 0.251 | 0.001 | 0.0021 | 0.0018 | 0.0001 | — | — | — | — | 100 | 2.68 | 1.723 | Inventive Example |
| 24 | 0.0098 | 0.02 | 2.99 | 0.253 | 0.001 | 0.0022 | 0.0019 | 0.0001 | — | — | — | — | 100 | 2.73 | 1.719 | Inventive Example |
| 25 | 0.0028 | 0.01 | 0.51 | 0.250 | 0.001 | 0.0019 | 0.0022 | 0.0001 | — | — | — | — | 100 | 2.97 | 1.790 | Inventive Example |
| 26 | 0.0030 | 0.01 | 4.99 | 0.249 | 0.001 | 0.0019 | 0.0021 | 0.0001 | — | — | — | — | 100 | 2.40 | 1.705 | Inventive Example |
| 27 | 0.0028 | 0.02 | 2.99 | 0.061 | 0.001 | 0.0020 | 0.0022 | 0.0001 | — | — | — | — | 100 | 2.66 | 1.739 | Inventive Example |
| 28 | 0.0025 | 0.02 | 2.94 | 1.991 | 0.001 | 0.0020 | 0.0018 | 0.0001 | — | — | — | — | 100 | 2.41 | 1.723 | Inventive Example |
| 29 | 0.0027 | 0.09 | 3.00 | 0.251 | 0.001 | 0.0018 | 0.0019 | 0.0001 | — | — | — | — | 100 | 2.59 | 1.734 | Inventive Example |
| 30 | 0.0028 | 0.19 | 3.03 | 0.248 | 0.001 | 0.0019 | 0.0017 | 0.0001 | — | — | — | — | 100 | 2.58 | 1.735 | Inventive Example |
| 31 | 0.0029 | 0.01 | 2.98 | 0.248 | 1.97 | 0.0022 | 0.0021 | 0.0001 | — | — | — | — | 100 | 2.51 | 0.701 | Inventive Example |
| 32 | 0.0033 | 0.02 | 2.98 | 0.249 | 0.001 | 0.0047 | 0.0020 | 0.0001 | — | — | — | — | 100 | 3.22 | 1.684 | Inventive Example |
| 33 | 0.0031 | 0.02 | 2.97 | 0.252 | 0.001 | 0.0018 | 0.0091 | 0.0001 | — | — | — | — | 100 | 3.34 | 1.678 | Inventive Example |

The invention claimed is:

1. A method for producing a non-oriented electrical steel sheet comprising a series of steps of hot rolling a slab having a chemical composition comprising C: not more than 0.01 mass %, Si: not more than 6 mass %, Mn: 0.05-3 mass %, P: not more than 0.2 mass %, Al: not more than 0.005 mass %, N: not more than 0.005 mass %, S: not more than 0.01 mass %, Ga: 0.0001-0.0005 mass %, and the remainder being Fe and inevitable impurities, pickling without conducting a hot band annealing, after conducting a self-annealing by coiling at a temperature of not lower than 650° C., subjecting to a single cold rolling or two or more cold rollings including an intermediate annealing therebetween and a finish annealing, and forming an insulation coating, characterized in that an average heating rate from 500 to 800° C. in the heating process during the finish annealing is not less than 50° C/s.

2. The method for producing a non-oriented electrical steel sheet according to claim 1, wherein the slab contains one or two of Sn: 0.01-0.2 mass % and Sb: 0.01-0.2 mass % in addition to the chemical composition.

3. The method for producing a non-oriented electrical steel sheet according to claim 2, wherein the slab contains one or more selected from Ca: 0.0005-0.03 mass %, REM: 0.0005-0.03 mass %, and Mg: 0.0005-0.03 mass % in addition to the chemical composition.

4. The method for producing a non-oriented electrical steel sheet according to claim 3, wherein the slab contains one or more selected from Ni: 0.01-2.0 mass %, Co: 0.01-2.0 mass %, Cu: 0.03-5.0 mass %, and Cr: 0.05-5.0 mass % in addition to the above chemical composition.

5. The method for producing a non-oriented electrical steel sheet according to claim 3, wherein the non-oriented electrical steel sheet has an iron loss $W_{15/50}$ of not more than 3.32 W/Kg and a magnetic flux density $B_{50}$ of not less than 1.702T.

6. The method for producing a non-oriented electrical steel sheet according to claim 2, wherein the slab contains one or more selected from Ni: 0.01-2.0 mass %, Co: 0.01-2.0 mass %, Cu: 0.03-5.0 mass %, and Cr: 0.05-5.0 mass % in addition to the above chemical composition.

7. The method for producing a non-oriented electrical steel sheet according to claim 3, wherein the non-oriented electrical steel sheet has an iron loss $W_{15/50}$ of not more than 3.32 W/Kg and a magnetic flux density $B_{50}$ of not less than 1.702T.

8. The method for producing a non-oriented electrical steel sheet according to claim 1, wherein the slab contains one or more selected from Ca: 0.0005-0.03 mass %, REM: 0.0005-0.03 mass % and Mg: 0.0005-0.03 mass % in addition to the chemical composition.

9. The method for producing a non-oriented electrical steel sheet according to claim 8, wherein the slab contains one or more selected from Ni: 0.01-2.0 mass %, Co: 0.01-2.0 mass %, Cu: 0.03-5.0 mass %, and Cr: 0.05-5.0 mass % in addition to the above chemical composition.

10. The method for producing a non-oriented electrical steel sheet according to claim 8, wherein the non-oriented electrical steel sheet has an iron loss $W_{15/50}$ of not more than 3.32 W/Kg and a magnetic flux density $B_{50}$ of not less than 1.702T.

11. The method for producing a non-oriented electrical steel sheet according to claim 1, wherein the slab contains one or more selected from Ni: 0.01-2.0 mass %, Co: 0.01-2.0 mass %, Cu: 0.03-5.0 mass % and Cr: 0.05-5.0 mass % in addition to the above chemical composition.

12. The method for producing a non-oriented electrical steel sheet according to claim 1, wherein the non-oriented electrical steel sheet has an iron loss $W_{15/50}$ of not more than 3.32 W/Kg and a magnetic flux density $B_{50}$ of not less than 1.702T.

* * * * *